US005353442A

United States Patent [19]

Rotter

[11] Patent Number: 5,353,442

[45] Date of Patent: Oct. 11, 1994

[54] RAPID ACTION PLUNGER

[75] Inventor: Karl Rotter, Dartmouth, Canada

[73] Assignee: Rapid Action Equipment Limited, Halifax, Canada

[21] Appl. No.: 178,111

[22] Filed: Jan. 6, 1994

[51] Int. Cl.[5] ..... E03D 11/00

[52] U.S. Cl. ..... 4/255.11

[58] Field of Search ..... 4/255.01-255.12

[56] References Cited

U.S. PATENT DOCUMENTS

| | | | |
|---|---|---|---|
| 739,120 | 9/1903 | Taylor . | |
| 766,734 | 8/1904 | Schellhammer . | |
| 1,040,276 | 10/1912 | Coleman . | |
| 1,047,726 | 12/1912 | Joggerst et al. . | |
| 2,128,217 | 8/1938 | Anderson . | |
| 2,218,050 | 10/1940 | Price . | |
| 2,274,453 | 2/1942 | Matter | 4/255.04 |
| 2,456,092 | 12/1948 | Storevik . | |
| 2,697,842 | 12/1954 | Meyer . | |
| 2,939,154 | 6/1960 | Gasser . | |
| 3,641,597 | 2/1972 | David . | |
| 3,644,943 | 2/1972 | Parodi et al. . | |
| 3,934,280 | 1/1976 | Tancredi . | |
| 4,096,597 | 6/1978 | Duse . | |
| 4,186,451 | 2/1980 | Chen-Min Ruo . | |
| 4,542,543 | 9/1985 | Irwin . | |
| 4,674,137 | 6/1987 | Girse . | |
| 4,733,414 | 3/1988 | Wilkes . | |

FOREIGN PATENT DOCUMENTS

| | | | |
|---|---|---|---|
| 155937 | 10/1910 | Canada . | |
| 243319 | 9/1924 | Canada . | |
| 339790 | 3/1934 | Canada . | |
| 358907 | 7/1936 | Canada . | |
| 438841 | 12/1946 | Canada . | |
| 529543 | 8/1958 | Canada . | |
| 893201 | 2/1972 | Canada . | |
| 0249487 | 7/1912 | Fed. Rep. of Germany | 4/255.05 |

*Primary Examiner*—Charles E. Phillips
*Attorney, Agent, or Firm*—Robert M. Phipps

[57] ABSTRACT

A plunger is described which utilizes the suction cup principle to its fullest potential. The suction cup action is actuated by a lever arm which is operatively connected to the suction cup rod. This device can further contain a splash guard which will eliminate splashing or spilling caused by the rapid plunger action.

5 Claims, 2 Drawing Sheets

RAPID ACTION PLUNGER

FIELD OF INVENTION

The present invention is directed to a drain or pipe clearing device wherein the motion of a suction cup to clear the drain or pipe is actuated by a lever arm operatively connected to the suction cup.

BACKGROUND AND PRIOR ART

A number of drain opening devices are known from the prior art. Those which apply force, other than that which is generated from the suction cup, include piston-type drain cleaning devices as described in U.S. Pat. Nos.: 2,218,050; 739,120; 766,734; 1,040,276; 1,047,726; 2,128,217; 2,456,092; 2,697,842; 3,641,597; 4,542,543; 4,186,451; 3,934,280; 4,733,414; 4,674,137 and Canadian Patents 339,790; 155,937; 243,319 and 529,543. The piston type suction plungers for clearing clogged drains or pipes are very complex in structure as can be seen from the above-noted references.

A second device used for clearing clogged drains relies on the use of compressed gas or air to provide the required pressure to clear the clogged drains. Examples of this type of drain clearing device can be found in U.S. Pat. No. 2,939,154 and Canadian Patent 358,907.

A third type is described in U.S. Pat. No. 3,644,943, which utilizes the suction cup action of a standard plunger, but replaces the firm handle with a resilient handle which is compressed and stretched as the operating handle is reciprocated. This device reportedly can be operated with use of only one hand and, therefore, has certain advantages over the known plunger device.

The present drain or pipe clearing device utilizes the suction cup principle to its fullest potential, with ease, and without resulting in any slashing or spilling caused by turbulence when the drain or pipe clearing device is in use.

SUMMARY OF INVENTION

The present invention is directed to a drain or pipe clearing device wherein the motion of a suction cup, to clear the drain or pipe, is actuated by a lever arm operatively connected to the suction cup.

According to one embodiment of the present invention, there is provided a drain or pipe clearing device comprising: a plunger-rod guide-pipe; a suction cup rod with attached suction cup, wherein the upper portion of said suction cup rod is mounted internally and coaxially with the lower portion of said plunger-rod guide-pipe; a lever arm pivotally connected to the upper portion of said plunger-rod guide-pipe; a link arm operatively connected at one end to the lever arm, at a position distal to the connection of the lever arm to the plunger-rod guide-pipe, and connected at the other end to the suction cup rod, wherein said connection to the suction cup rod is through an aperture cut in the lower end of the plunger-rod guide-pipe; whereby actuation of the lever arm causes said suction cup rod to move telescopically relative to said plunger-rod guide-pipe, thereby causing motion of said suction cup to clear the drain or pipe.

The drain or clearing device of the present invention can further comprise a splash guard mounted on the plunger-rod guide-pipe to reduce or eliminate any splashing or spilling, caused by turbulence, when the drain or pipe clearing device is in use.

DETAILED DESCRIPTION OF THE PREFERRED EMBODIMENT

The device of the present invention is for clearing blockages in drains or pipes associated with sinks, baths or the like, toilets and other similar like structures.

Figure 1:
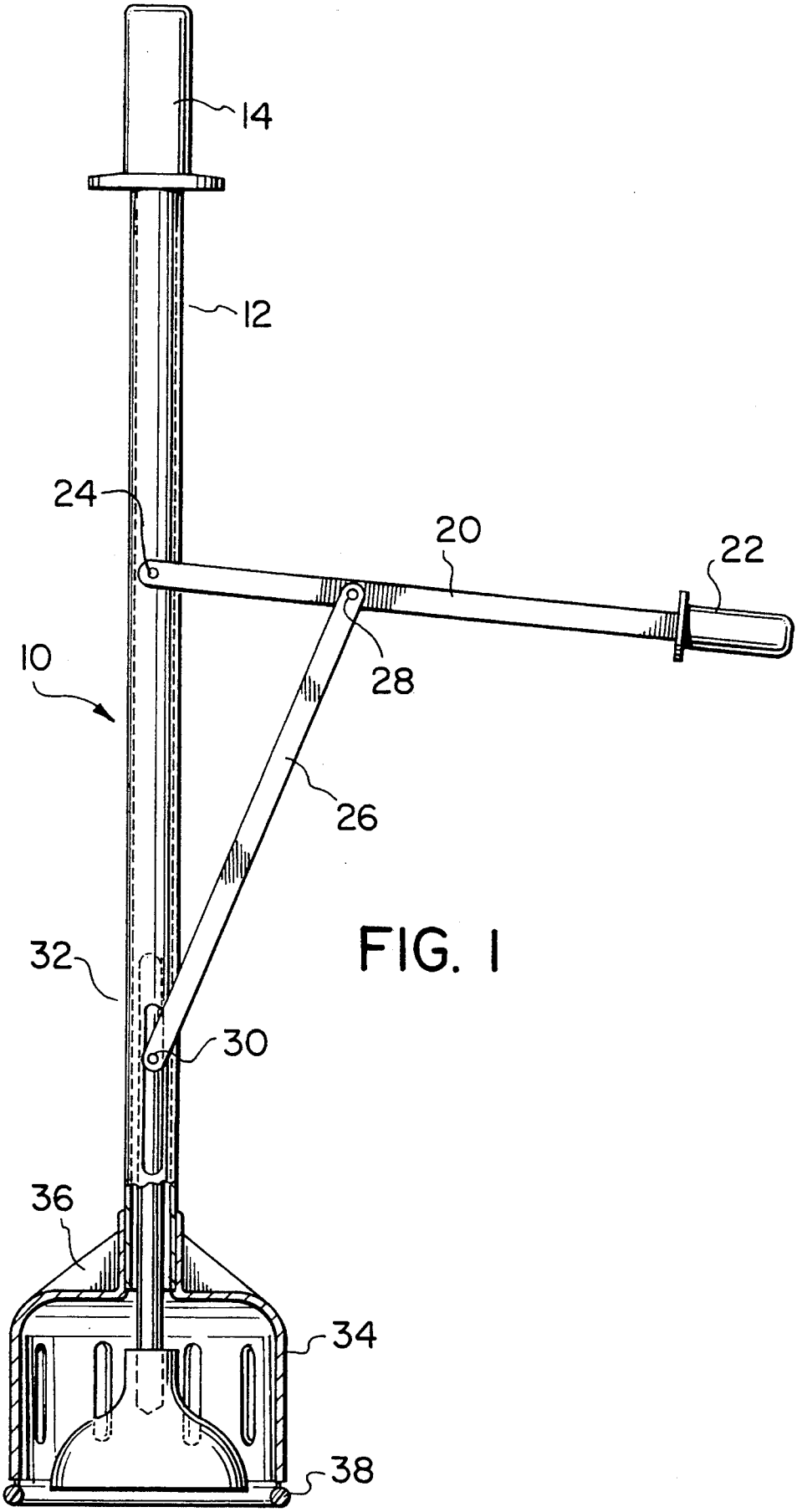
FIG. 1 is a view of the vertical longitudinal section of the device in an extended position.
Figure 2:
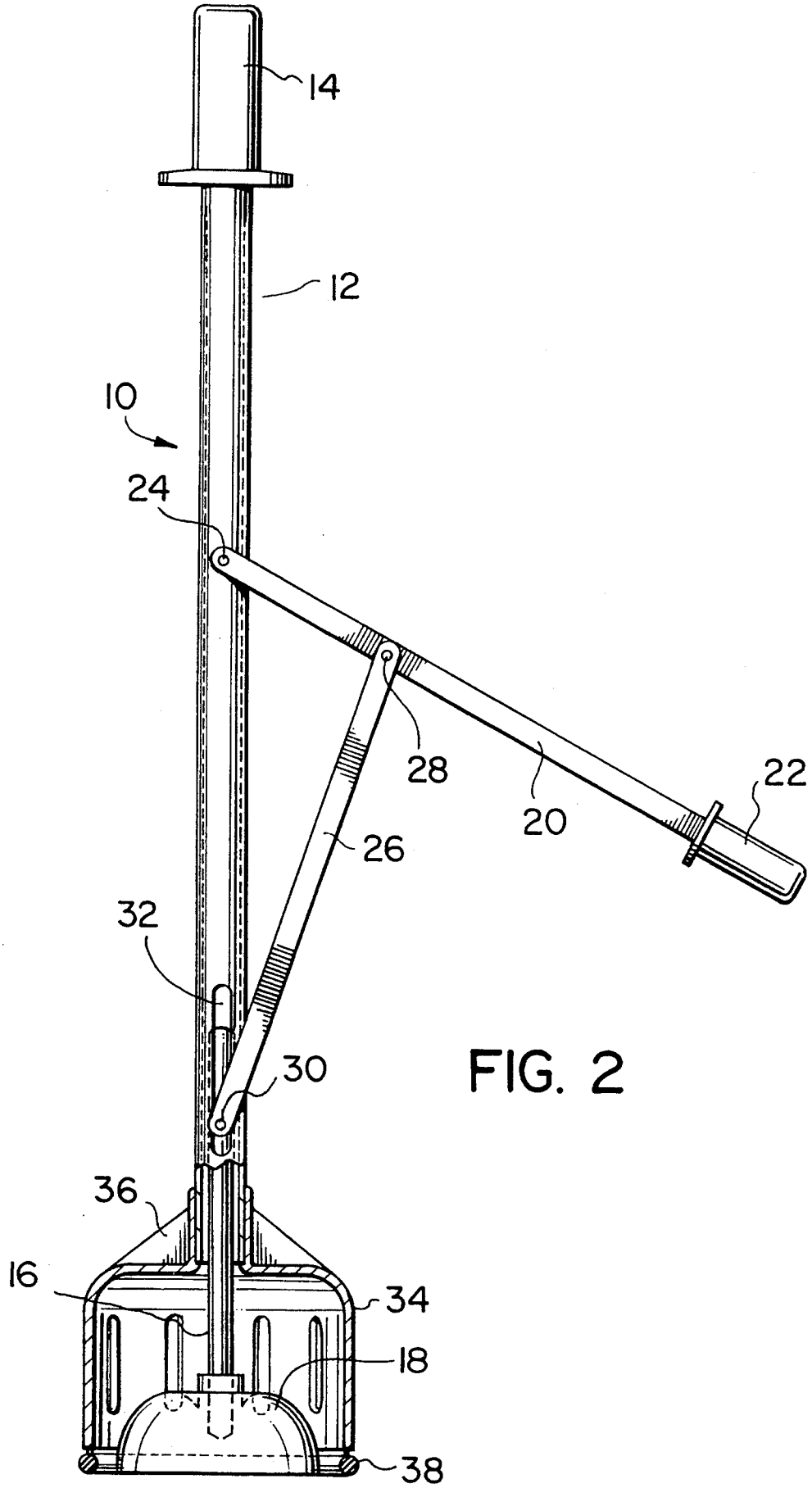
FIG. 2 is a similar view as shown in FIG. 1, except that the suction cup is in a compressed position.

Referring to FIG. 1 and FIG. 2, the device, generally referred to by reference number 10, includes a cup-shaped member in the form of a suction or compression cup 18, which is part spherical or hemispherical in shape and which is mounted at the bottom of a rigid suction cup rod 16. The suction cup rod 16 can be made of any rigid substance such as synthetic plastics, metal, or wood.

The suction cup rod 16 is mounted internally and coaxially with the lower portion of a hollow plunger-rod guide-pipe 12. Within the plunger rod guide pipe the suction cup rod is shown in phantom. The plunger-rod guide-pipe 12 can be made of any suitable rigid material such as synthetic plastics, metal, or wood. The guide-pipe 12, for convenience and ease of operation, can have a top handle 14 mounted on the top end, distal from the end which receives the suction cup rod 16. A lever arm 20 is pivotally connected, by a first pivotal connection means 24, to the upper half of the guide-pipe 12. At the distal end of the lever arm 20, can be placed a lever handle 22, for convenience and ease of operation.

Connection between the lever arm 20 and the suction cup rod 16 is made via a link arm 26. The link arm is pivotally connected at one end to the lever arm 20 by a second pivotal connection means 28. The link arm is pivotally connected at its other end to the suction cup rod 16 via a third pivotal connection means 30. All pivotal connection means are intended to include any such means known in the art, provided that freedom of movement is not restricted.

The connection of the link arm 26 to the suction cup rod 16 is accomplished through an aperture 32, cut in the lower end of the plunger-rod guide-pipe 12. The aperture 32 is an elongated slot, which is positioned on the guide-pipe 12 in such a fashion that it will not interfere with the third pivotal connection means 30 when the drain or pipe clearing device is in use.

The proper positioning of the connection points of the lever arm to the plunger-rod guide-pipe and the link arm to the lever arm is within the skill of a person in the art. Placement must be such that the actuation of the lever arm will result in the proper pressure/suction actions to clear the obstruction from the drain or pipe.

In one embodiment of the present invention, the drain or pipe clearing device further comprises a splash guard 34 (cut away in the drawings in order to view the lower end of the suction cup rod and the suction cup), which is rigidly connected to the end of the plunger-rod guide-pipe 12, distal from the end receiving the top handle. A rigid connection between the splash guard and the plunger-rod guide-pipe can be facilitated with the use of splash guard brackets 36. A rubber or plastic seal 38 on the open end of this splash guard provides a no-slip contact with the toilet bowl or drain opening ensuring continued plunger/drain hole alignment during operation. Furthermore, the plunger-rod guide-pipe 12 and the splash guard 34 provide a movement guide for the suction cup rod 16 ensuring continuous plunger/drain hole alignment.

The splash guard also comprises a plurality of holes 40 around the lower end to allow the water level to equivalize within and outside the splash guard during operation to exclude air build-up in the suction cup and drain pipe in order to ensure efficient results.

In use, the device alternates from the position shown in FIG. 1 and FIG. 2 by an up and down pumping motion of the lever arm 20, while holding the device in position over the drain hole with the other hand. In FIG..1 the handle is in its upper-most position and the suction cup 18 is in its extended position. When the lever arm 20 is in a down position, the link arm 26 will lower the vertical position of the suction cup rod 16 causing the suction cup 18 to compress as shown in FIG. 2. As noted previously, the aperture 32 cut in the plunger-rod guide-pipe 12 will facilitate the movement as described above.

The device is thus placed over the outlet orifice of a sink, bath or toilet or the like so that the suction cup 18 completely covers the orifice and bears all around it on the bottom of the sink, bath or tub. The pumping action of pressure alternating with suction is therefore produced in the outlet pipe, which loosens, releases and displaces any blockages therein and thus clears the blocked pipe. Sufficient water in the drain and around the plunger is critical for a successful unclogging process. Excluding air access to the drain and plunger is critical as air in the system diminishes the suction effect and consequently, effective results.

It is understood that the invention has been disclosed herein in connection with certain examples and embodiments. However, such changes, modification or equivalence as can be used by those skilled in the art, are included intended to be included. Accordingly, the disclosure is to be construed as exemplary, rather than limiting, and such changes within the principle of the invention as are obvious to one skilled in the art are intended to be included within the scope of the claims.

The embodiments of the invention in which an exclusive property or privilege is claimed are defined as follows:

1. A drain or pipe clearing devise comprising:

a plunger-rod guide-pipe;

a suction cup rod with attached suction cup, wherein the upper portion of said suction cup rod is mounted internally and coaxially with the lower portion of said plunger-rod guide-pipe;

a lever arm pivotally connected to the upper portion of said plunger-rod guide-pipe;

a link arm operatively connected at one end to the lever arm, at a position distal to the connection of the lever arm to the plunger-rod guide-pipe, and connected at the other end to the suction cup rod, wherein said connection to the suction cup rod is through an aperture cut in the lower end of the plunger-rod guide-pipe;

whereby actuation of-the lever arm causes said suction cup rod to move telescopically relative to said plunger-rod guide-pipe, thereby causing motion of said suction cup to clear the drain or pipe.

2. A drain or pipe clearing device according to claim 1 further comprising a splash guard which is mounted on the lower portion of said plunger-rod guide-pipe to encircle the suction cup.

3. A drain or pipe clearing device according to claim 2 wherein the splash guard comprises a rubber seal at the distal portion thereof.

4. A drain or pipe clearing device according to claim 3 wherein the splash guard comprises a plurality of apertures to allow water to equivalize on both sides of said splash guard.

5. A drain or pipe clearing device according to claim 1 wherein said lever arm is a reciprocal operating lever arm moving between a first position wherein the suction cup is in an extended position and a second position wherein said suction cup is in a compressed position.

* * * * *